US005666331A

United States Patent [19]

Kollin

[11] Patent Number: 5,666,331

[45] Date of Patent: Sep. 9, 1997

[54] ALARM CLOCK

[75] Inventor: Adam J. Kollin, Rochester Hills, Mich.

[73] Assignee: RHK Technology, Inc., Rochester Hills, Mich.

[21] Appl. No.: 309,197

[22] Filed: Sep. 20, 1994

[51] Int. Cl.[6] ..... G04B 21/08

[52] U.S. Cl. ..... 368/245; 368/10; 368/250

[58] Field of Search ..... 368/245, 10, 240–275

[56] References Cited

U.S. PATENT DOCUMENTS

| | | | |
|---|---|---|---|
| 1,486,608 | 3/1924 | Schroeder | 368/281 |
| 1,927,765 | 9/1933 | Wisely | 58/16 |
| 2,190,533 | 2/1940 | MacPherson | 161/22 |
| 3,255,582 | 6/1966 | Zam | 58/57.5 |
| 3,545,195 | 12/1970 | Krischker | 58/19 |
| 3,681,916 | 8/1972 | Itoyama et al. | 58/39 |
| 4,028,882 | 6/1977 | Muncheryan | 58/152 B |
| 4,060,973 | 12/1977 | Martino | 58/19 R |
| 4,093,944 | 6/1978 | Muncheryan | 340/279 |
| 4,203,278 | 5/1980 | Kondo et al. | 368/73 |
| 4,203,279 | 5/1980 | Kamiya | 368/243 |
| 4,297,677 | 10/1981 | Lewis et al. | 340/148 |
| 4,365,238 | 12/1982 | Kollin | 340/521 |
| 4,377,345 | 3/1983 | Yamada et al. | 368/245 |
| 4,421,953 | 12/1983 | Zielinski | 179/2 EC |
| 4,456,387 | 6/1984 | Igarashi | 368/230 |
| 4,459,037 | 7/1984 | Toyoda | 368/255 |
| 4,637,732 | 1/1987 | Jones et al. | 368/109 |
| 4,777,474 | 10/1988 | Clayton | 340/539 |
| 4,879,699 | 11/1989 | Sakamoto | 368/63 |
| 4,920,525 | 4/1990 | Meister | 368/250 |
| 4,964,108 | 10/1990 | Ohtsu et al. | 368/10 |
| 5,016,229 | 5/1991 | Gibbens, Jr. | 368/10 |
| 5,023,853 | 6/1991 | Kawata et al. | 368/230 |
| 5,089,998 | 2/1992 | Rund | 368/72 |
| 5,212,672 | 5/1993 | Loisch et al. | 368/79 |
| 5,243,568 | 9/1993 | Burch et al. | 368/73 |
| 5,313,523 | 5/1994 | Kawauchi | 368/187 |

FOREIGN PATENT DOCUMENTS 2205665 12/1988 United Kingdom ..... G04G 1/00

OTHER PUBLICATIONS

Sonic Alert Catalog.

*Primary Examiner*—Bernard Roskoski

*Attorney, Agent, or Firm*—Young & Basile, PC

[57] ABSTRACT

An alarm clock controls the supply of electrical power to a first outlet mounted on the clock housing and receiving a plug-in external electrical device to periodically change the state of the electrical device in response to an alarm time signal. A second controllable outlet is also mounted on the housing for receiving a second plug-in external electrical device. Selectible steady or pulse power is provided to the second outlet. A receiver detects power line carrier signals on the incoming electrical power lines generated by a remote device in response to the occurrence of a sound producing event or other signal. The receiver causes the clock to supply power to either or both outlets depending on the position of a function switch in response to a detected power line carrier signal. An audible sound generator provides an audible alarm tone in response to an alarm signal. Frequency and volume controls selectively vary the frequency and volume of the audible alarm tone. A test button activates the outlets and audible sound generators to test proper operation and desired settings of the alarm clock.

19 Claims, 5 Drawing Sheets

ALARM CLOCK

BACKGROUND OF THE INVENTION

1. Field of the Invention

The present invention relates, in general, to alarm clocks and, more specifically, to alarm clocks for the deaf, hearing impaired or heavy sleepers.

2. Description of the Art

Alarm clocks are widely used to awaken individuals at a user set time. However, deaf people, people having varying degrees of hearing impairment, and even heavy sleepers are not usually able to hear an alarm clock which typically generates an audible sound when the time of day coincides with the preset alarm time.

In order to overcome this problem and to provide alarm clocks which are usable by the deaf, hearing impaired and heavy sleepers, wrist watches and standard alarm clocks have been devised to provide a visual output, such as a flashing light, or a tactile output, such as vibrations, which can be easily detected. Such alarm clocks have also been provided with a remotely useable vibrator which is attachable to the alarm clock and activated when the time of day coincides with the preset alarm time to provide detectible vibrations to a pillow or directly to the person sleeping in a bed.

Other alarm clocks have been devised with variable volume and different preset tones for use by people suffering from only minimal degree of hearing impairment or who have difficulty waking up to conventional alarm tone or buzzer.

Various other hearing impaired devices have also been devised to aid the hearing impaired in detecting the occurrence of certain events, typically events which create an audible sound, such as a doorbell, telephone, baby monitor, smoke detector, etc. U.S. Pat. No. 4,365,238, issued to the Applicant, discloses a visual signaling device in which sound sensors, in response to the occurrence of a nearby sound producing event, such as a doorbell or telephone ring, a sound from a baby or child, or the activation of a smoke detector, generate a unique radio frequency signal which is transmitted to a central receiver. The receiver central is connected to a building or home electrical power line distribution network to transmit coded line carrier signals over the building power lines to remote units which are typically plugged into various outlets in the building or home. The remote units control the supply of electrical power to an electrical device, such as a lamp, plugged into each remote unit. The remote units flash the lamp on and off at a predetermined sequence in accordance with the sound producing event detected by a particular sound sensor. This provides the deaf or hearing impaired with a visual indication of the occurrence of a particular sound producing event due to the sequence of on and off changes of the lamp.

However, prior to the Applicant's present invention, an alarm clock has not been devised which combines the features of visual, or a tactile outputs with a power line carrier system to provide an indication to a deaf or hearing impaired person and/or heavy sleeper of the occurrence of a remote sound producing event or other signal that can trigger a remote transmitter. Thus, it would be desirable to provide an alarm clock which provides these features in a simple, expedient manner. It would also be desirable to provide an alarm clock having these features which is simple in construction and use. It would also be desirable to provide an alarm clock having these features which provides either or both of a selected visible light or vibratory output. It would also be desirable to provide an alarm clock having these features which also includes a conventional audible tone or sound generator, with the provision of variable volume and frequency or tone controls for use by persons suffering from varying degrees of hearing impairment who can still hear high volume sounds or certain sound frequencies.

SUMMARY OF THE INVENTION

The present invention is an alarm clock which is particularly devised for the deaf, hearing impaired or heavy sleepers.

The alarm clock, which is connectible to A.C. electrical power lines, includes a housing and a display mounted on the housing for displaying time of day and alarm time information. A clock means or circuit is mounted in the housing for generating time of day information to the display. The clock means generates an alarm signal when the time of day corresponds to the preset alarm time. Switch means are input to the clock means for setting time of day and alarm time information and for deactivating the alarm signal after it is activated. A first electrical outlet is mounted in the housing for supplying electrical power to an external electrically operated device which is plugged into the first outlet. A receiver means is mounted in the housing for receiving and detecting line carrier signals transmitted over the electrical power lines from a remote transmitter in response to the occurrence of an audible sound producing event or other input signal or stimulus detected by the remote transmitter. Finally, a first switch means is provided for switching the electrical power to the first outlet in response to any of the generation of the alarm signal and the detection of power line carrier signals by the receiver means.

An audible sound generator means is also mounted in the housing for generating an audible sound in response to the alarm signal. Means are provided for varying at least one and preferably both of the frequency and the volume of the audible sound generated by the audible sound generator means.

A second outlet is optionally mounted on the housing for supplying electrical power to a second external electrically operated device which can be plugged into the second outlet. The first switch means also switches electrical power to the second outlet in response to either or both of the generation of the alarm signal and the detection of the power line carrier signals by the receiver means. Preferably, the first switch means periodically varies the electrical power supplied to the second outlet so as to sequence the second external electrical device connected to the second outlet in either a repetitious pulse or continuous steady mode of operation.

Preferably, the first switch means also includes means for periodically supplying electrical power to the first outlet at a time varying periodic rate corresponding to the cyclic rate of the power line carrier signals.

A test switch means is mounted on the housing and connected to the first switch means for testing the proper operation and setting of the tone and volume controls of the audio sound generator means and the supply of power to the first and second outlets. A remote receiver enable/disable switch may be mounted on the housing for selectively enabling or disabling the remote power line carrier signal receiver means.

The alarm clock of the present invention uniquely controls the supply of electrical power to one or more controllable outlets which receive plug-in electrically operated devices, such as a lamp or vibrator, to flash or pulse such devices upon generation of an alarm time signal. The present alarm clock also uniquely supplies electrical power to the outlets in response to the receipt of a line carrier signal from a remote device which transmits the carrier line signal on the building electrical power lines to which the alarm clock is connected in response to a sound producing event or other input signal or stimulus remote from the location of the alarm clock. The receiver means in the alarm clock pulses the electrical power supplied to the outlets at the periodic rate of the power line carrier signals, which may be different for each remote transmitter. This enables the present alarm clock to activate the device or devices connected to the outlet(s) in response to the occurrence of a remote sound producing event or other input signal or stimulus, which capability has heretofore not been available in an alarm clock devised for the deaf, hearing impaired or even heavy sleepers.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
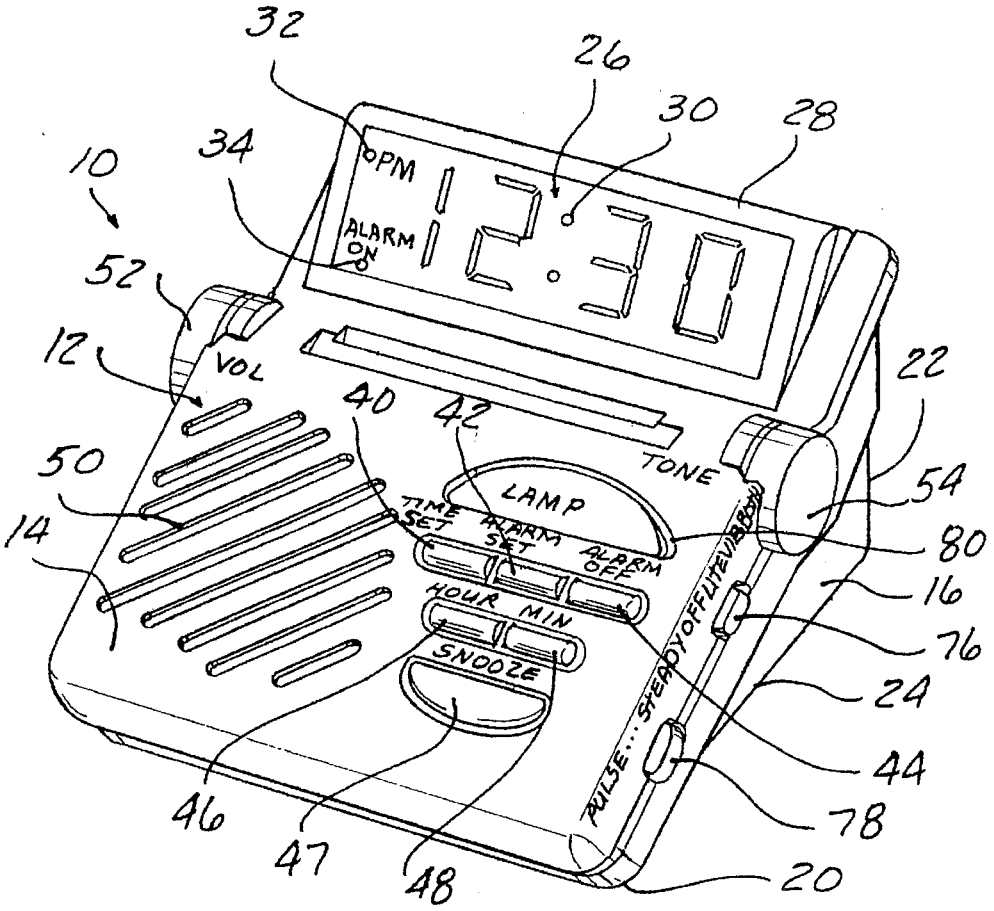
FIG. 1 is a perspective view of an exemplary construction of an alarm clock of the present invention.

Referring now to the drawing, and to FIGS. 1–5B in particular, there is depicted an alarm clock 10 which is particularly devised for use by the deaf, hearing impaired or heavy sleepers.

The alarm clock 10 includes a housing 12 which may have any suitable form. By way of example only, the housing 12 includes an angularly disposed top wall 14, opposed side walls 16 and 18, a front wall 20, a rear or back wall 22 and a bottom wall 24.

A display 26 is mounted in a housing part 28 which is pivotally mounted in a recess formed between one end of the front wall 14 and the upper edge of the back wall 22. This enables the housing past 28 to be pivoted from a lower position generally in line with the angled front face 14 of the housing 12 to a raised position, shown in FIG. 1, for easy visibility of the display 26.

The display 26 may be any suitable electronic display, such as LED or LCD display containing multiple digits consistent with displaying time and alarm information. A ":" is also provided in the display 26 for separating the hours from the minutes portion in the display. The ":" may flash at a cyclic one second rate in a conventional manner.

Various indicators 32 and 34 are also in the display 26. The indicator 32, which may be an LED, is energized when the time of day is between 12:00 noon and 12:00 midnight to indicate a "pm" time. The other indicator 34 is activated when an alarm is enabled by the user.

Various other indicators, not shown, may also be provided on the display 26 for indicating whether any of the separate outlets on the housing 12, as described hereafter, are energized or whether the remote power line carrier signal receiver is energized or de-energized.

Figure 2:
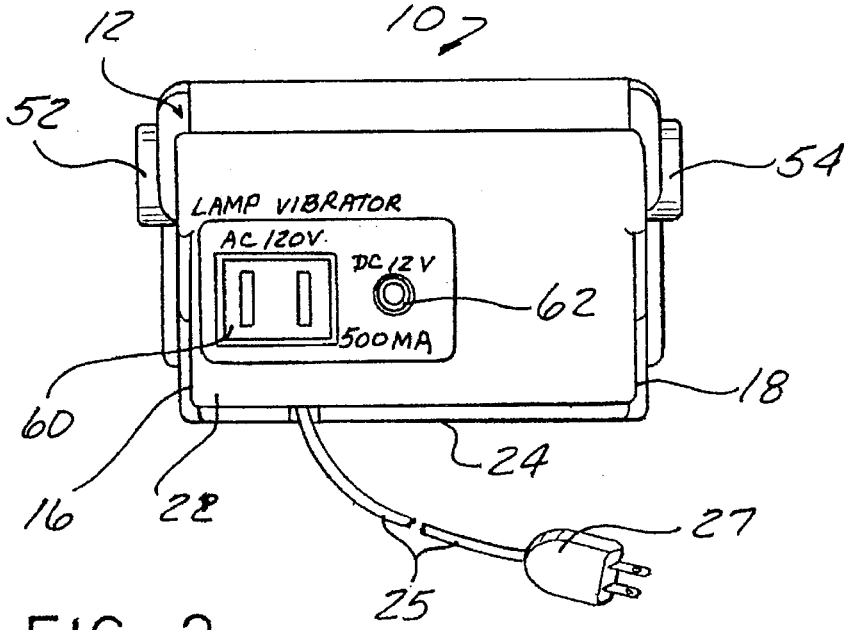
FIG. 2 is a rear view of the alarm clock shown in FIG. 1.

As shown in FIG. 2, an electrical conductor or cord 25 extends from the back wall 22 of the housing 12 and terminates in a plug 27 which is removably insertable into a conventional electrical outlet to connect the internal circuits of the alarm clock 10, as described hereafter, to electrical power carried on electrical power line conductors 23.

Various switches or pushbuttons, conventionally found in alarm clocks, are mounted on the top wall 14 of the housing 12. By way of example only, a time set pushbutton 40, an alarm set pushbutton 42 and an alarm off pushbutton 44 are mounted on the top wall 14 of the housing 12. In addition, hour and minute set pushbuttons 46 and 48 are also mounted on the top wall 14. The time set and alarm set pushbuttons 40 and 42 operate in conjunction with the hour and minute set pushbuttons 46 and 48 to set current time of day and alarm time information. In a conventional manner, depression of the time set pushbutton 40 enables a user to set the current time of day by then depressing either the hour or minute set pushbuttons 46 and 48 until the display 26 displays the current time of day. It will be noted that with the time set pushbutton 40 depressed, the hour and/or minute pushbuttons 46 and 48 may be depressed and immediately released to advance the hour or minute display by one increment or held in a depressed state to enable the alarm clock circuit, described hereafter, to advance the respective hour or minute display at a cyclic rate. Release of the hour or minute pushbutton 46 and 48 will set the hour and minute portion of the display 26 at the desired current time of day.

The same sequence is employed with the alarm set pushbutton 42 in which the user depresses the alarm set pushbutton 42 and then the hour and minute set pushbuttons 46 and 48 to preset a desired alarm time. The alarm off pushbutton 44 is pushed once to enable or set the alarm, as indicated by the "alarm on" indicator 34 in the display 26. Depression of the alarm off pushbutton 44 a second time disables the alarm.

Figure 5A:
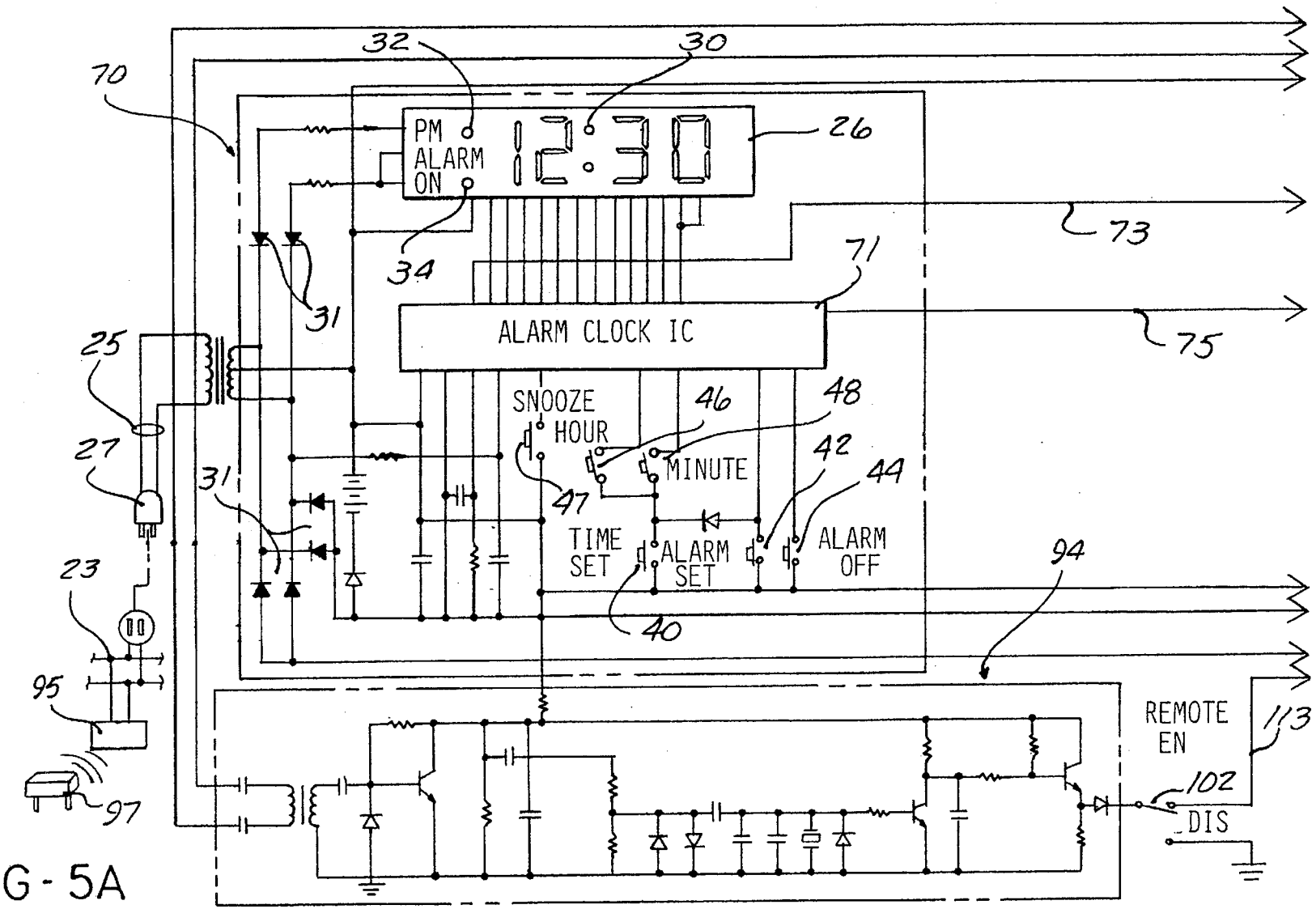
FIGS. 5A and 5B are schematic diagrams of the circuitry shown generally in FIG. 4.
Figure 5B:
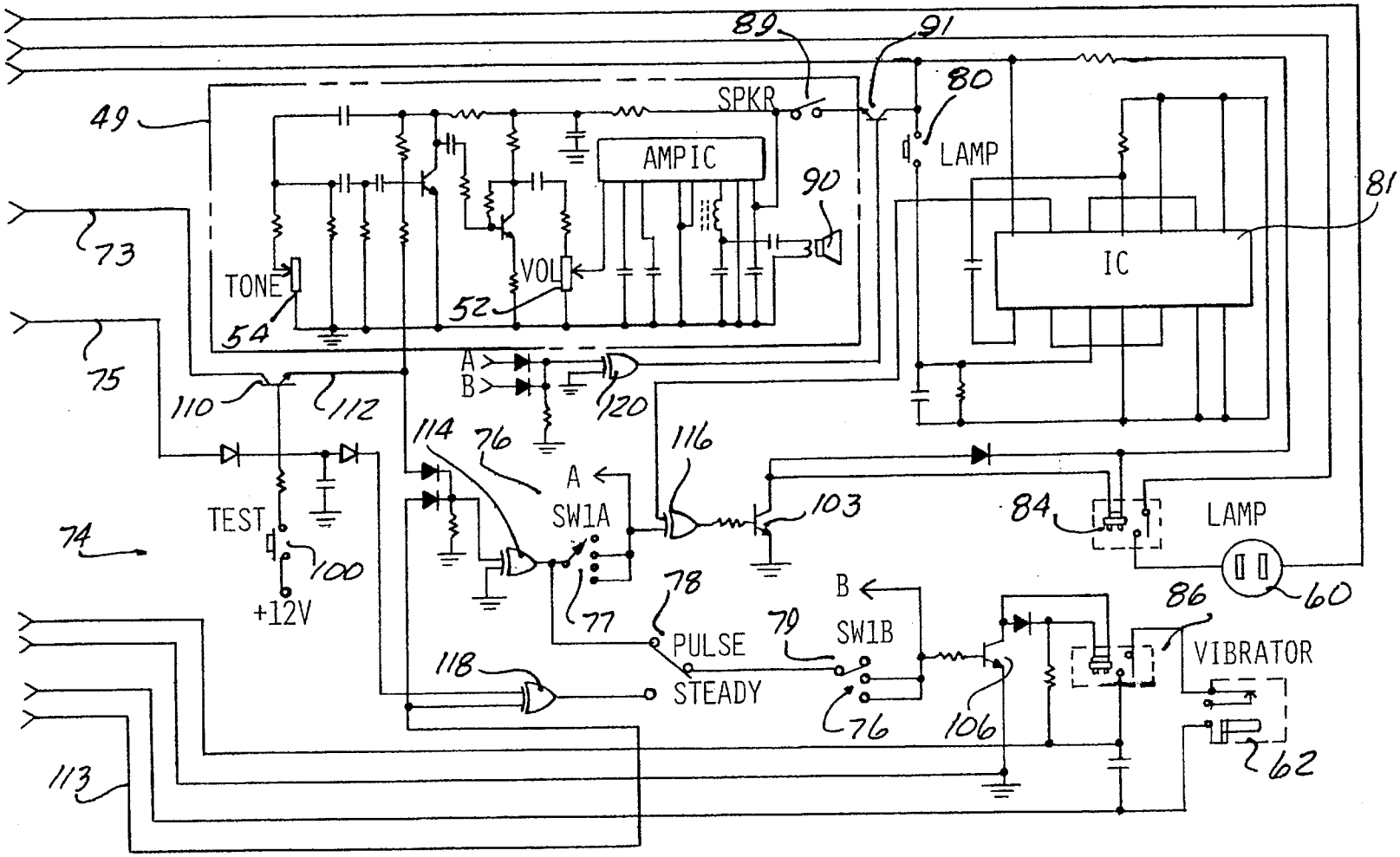

An audible sound generator means 49, described hereafter and shown in FIG. 5B, is mounted within the housing 12. A grill 50, shown in FIG. 1, is formed on the front face 14 of the housing 12 for covering the audible sound generator means 49. A volume control means 52, such as a rotary switch or knob, is mounted on the housing 12 for varying the volume of the audible sound generated by the audible sound generating means 49. Similarly, an adjustable tone means 54 in the form of a rotary knob is also mounted on the housing 12 for selectively varying the frequency or tone of the audible sound generated by the audible sound generating means 49.

The various other input switches on the alarm clock 10 will be described hereafter in conjunction with their respective features and corresponding circuitry.

Figure 4:
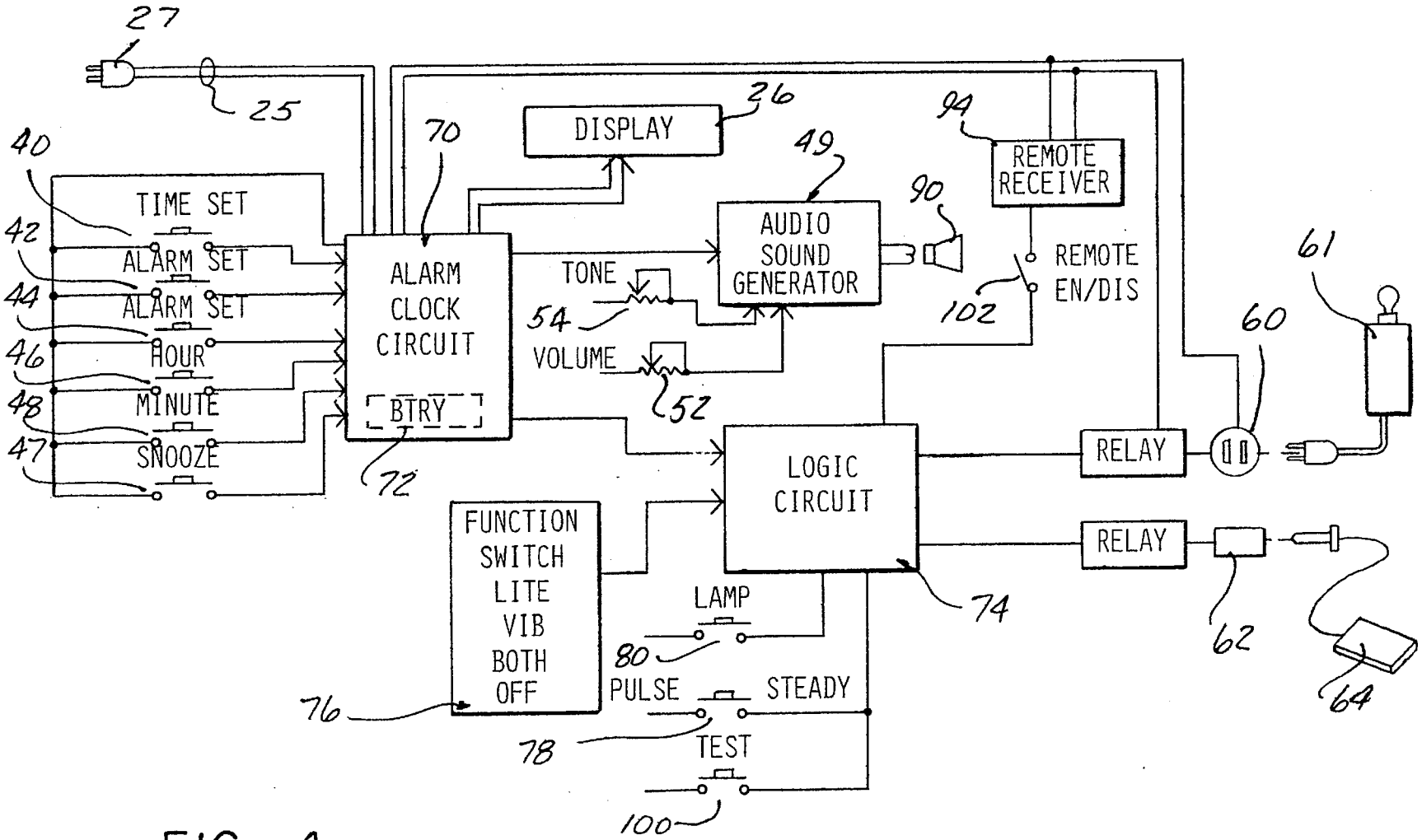
FIG. 4 is a block diagram of the circuitry employed in the alarm clock shown in FIGS. 1–3.

As shown in FIGS. 2 and 4, a first electrical outlet 60, labelled "lamp", for receiving an electrical plug on a conductor connected to an external electrically operated device is mounted on the rear wall 22 of the housing 12 and connected to internal circuitry, as described hereafter. By way of example only, the first electrical outlet 60 provides 120 volt A.C. power. Further, the external electrically operated device adapted to be plugged into the first outlet 60 is a conventional lamp 61 containing an illuminatable light bulb.

According to a preferred embodiment of the present invention, a second outlet 62, labelled "vibrator", is also mounted on the rear wall 22 of the housing 12. The second outlet 62 is preferably a 12 volt D.C. outlet in the form of a single pin receptacle adapted to receive a single pin D.C. plug connected to an external, electrically operated device, such as a vibrator.

Referring now to FIGS. 4, 5A and 5B, there is respectively disclosed a block diagram and the detailed circuitry of the alarm clock 10. Electrical power line conductors 23 are connected to a suitable electrical outlet in a building which receives the plug 27 at the end of the conductor 25 extending from the alarm clock 10. The electrical conductor 25 supplies 120 volt A.C. power to a transformer 19 which outputs a low level A.C. voltage. This voltage is converted by diodes 31 to a D.C. voltage required by the electronic components of the alarm clock 10.

Optionally, a backup power supply, such as a 9 volt battery 72, is mounted in the housing 12 and accessible through a removable cover on the bottom wall 24 to provide electrical power to an alarm clock circuit 70 in the event of disruption of electrical power on the power line conductors 23. A conventional alarm clock circuit 70 is mounted within the housing 12 and generates time of day and alarm time signals which are output to the display 26. The alarm clock circuit, by example, includes an alarm clock IC 71, such as an alarm clock IC, Model No. TMS 3450, sold by Texas Instruments.

The various pushbuttons 40, 42, 44, 46 and 48 are connected as inputs to the alarm clock IC 71, as shown in FIG. 5A. In addition, a snooze pushbutton 47 mounted on the top wall 14 of the housing 12 is also input to the alarm clock IC 71.

As shown in FIGS. 1, 4 and 5B, a function switch 76 is mounted on the side wall 16 of the housing 12. The function switch 76 is preferably a two-pole slide switch having four positions and outputs designated "light, vib, both, and off". Each position of the function switch 76 provides a separate signal to a logic circuit 74 to select which, if any, of the outlets 60 and 62 are to receive electrical power. In a first position labeled "off", both of the first and second outlets 60 and 62 are disabled from supplying electrical power to the external devices 61 and 64 respectively connected thereto. In a second position designated "light", the first outlet 60 is enabled to supply electrical power to the lamp 61 when an alarm signal is generated by the alarm clock IC 71. In the third position designated "vib", only the second outlet 62 is enabled to supply power to the second external electrical device, such as a vibrator 64, connected thereto upon generation of the alarm signal. In the fourth position labeled "both", both of the first and second outlets 60 and 62 are enabled.

The logic circuit 74 controls the supply of electric power to the first and second outlets 60 and 62 depending upon the position of the function switch 76 as shown in FIG. 5B. A constant alarm signal 75 from the alarm clock IC 71, generated when the time of day coincides with a preset alarm time, will switch transistor 110 to a conductive state. A cyclic or pulsing signal 73 is output from the alarm clock IC 71 whenever power is supplied to the alarm clock IC. The cyclic signal 73 switches between high and low voltage levels at a set frequency, such as one hertz, for example. The cyclic or pulsing signal 73 from the alarm clock IC 71 is connected to the transistor 110 such that when the transistor 110 is switched to a conducting state by the constant alarm signal 75, a pulsating signal is supplied to line 112, shown in FIG. 5, at the cyclic rate, such as one hertz, of the cyclic signal 73. This cyclic signal on line 112 is input to an OR gate 114 which functions as a simple OR gate even though it is depicted as an exclusive OR gate. The output of the OR gate 114 is corrected to contact 77 of the first pole SW1A of the function switch 76 and provides the cyclic one hertz signal through the contact 77, when the first pole SW1A of the function switch 76 is in either the second or fourth positions corresponding to light only or both light and vibrator. These switch position outputs are connected in parallel and input to an OR gate 116, the output of which, when high, drives transistor 103 to a conductive state and energizes the coil of relay 84 to cause the contact of the relay 84 to switch to a closed position thereby supplying power to the outlet 60 to energize the lamp 61 plugged into the outlet 60 at the cyclic one hertz signal rate. The relay 84 cycles on and off at the one hertz signal rate thereby alternatingly supplying power to the first outlet 60 to turn the lamp 61 plugged into the outlet 60 on or off at a one hertz rate.

It will be understood that the cyclic control of power to the outlet 60 will cause the lamp 61 to cyclically flash on and off regardless of the initial state of the lamp 61. Thus, if the lamp 61 is initially off by the logic circuit 74, the logic circuit 74 will cause the lamp 61 to turn on and then cycle between on and off states until the alarm signal 75 ceases. Alternately, if the lamp 61 is initially on, the logic circuit 74 will first turn the lamp 61 off and then cycle the lamp 61 between off and on states until the alarm signal 75 is terminated.

A switch 80, labelled lamp, is also mounted on the front face 14 of the housing 12. The switch 80 is input to an anti-bounce flip-flop IC 81, as shown in FIG. 5B. The output of IC 81 is connected to an input of OR gate 116 to drive transistor 103 and relay 84 and thereby control the supply of electrical power to the first outlet 60 and thereby the state of the lamp 61 plugged into the first outlet 60 separate from the alarm circuit 70.

In a normal mode of operation, the on/off switch on the lamp 61 will be placed in the "on" position and the lamp 61 plugged into the first outlet 60. This arrangement places the supply of electrical power to the lamp 61 directly under the control of the logic circuit 74. Depressing the switch 80 a first time causes the IC 81 to switch the state of electrical power supplied to the outlet 60 and thereby change the state of the lamp 61 from "off" to "on". Depressing the "lamp" switch 80 a second time will de-energize the relay 84 and turn the lamp 61 off. This enables the user to employ the lamp 61 in a normal manner by turning the lamp 61 "on" or "off" as desired by means of the switch 80.

The output of OR gate 114 is also connected to a switch 78. The switch 78 is mounted on the side wall 16 of the housing 12 and is switchable between two positions labeled "pulse" and "steady". The output of the switch 78 is connected to a contact 79 of the second pole SW1B of the function switch 76. The third and fourth output positions of the second pole SW1B of the function switch 76, corresponding respectively to vibrator only or both lamp and vibrator, are connected in parallel to the base of transistor 106. When power is supplied through the contact 79, as described hereafter, the transistor 106 is driven to a conducting state and completes a path to ground through the coil of relay 86 to energize relay 86 and cause the switchable contact of the relay 86 to switch to a closed position connecting D.C. power to the second outlet 62.

When the switch 78 is in the "PULSE" position, the output of OR gate 114 is connected to the contact 79 of the second pole SW1B of the function switch 76. As described above, the output of OR gate 114 cycles at the predetermined rate of the cyclic signal 73 from the alarm clock IC 71 to cause power to be alternatingly supplied to the relay 86 and thereby to the second outlet 62.

The second contact position of the switch 78, labeled "STEADY" is connected to the output of OR gate 118. One of the inputs to the OR gate 118 is the constant alarm signal 75 from the alarm clock IC 71. As the alarm signal 75 remains at a constant voltage as long as the alarm signal 75 is generated by the alarm clock IC 71, a steady or constant supply of power is supplied through the second pole SW1B of the function switch 76 and thereby to the relay 86 and the second outlet 62.

The alarm signal 75 is immediately and permanently discontinued by depression of the alarm off pushbutton 44, or temporarily discontinued by depression of the snooze pushbutton 49.

The cyclic signal 73 gated through transistor 110 by a "high" alarm signal 75 is also connected to an oscillator circuit forming a part of the audible sound generator means 49, which includes an amplifier connected to a tone generating element 90, such as a speaker, piezoelectric element, etc., mounted within the housing 12 immediately adjacent the exterior grill 50 on the top wall 14 of the housing 12. The volume control 52 and the tone control 54 are used to control the volume and thetone or frequency of the audible sound generated by the audible sound generator means 49. This enables a user to select the volume level and the particular tone or frequency of the audible sound generated by the audible sound generator 49 which the user finds to be most effective in providing a wakeup alarm signal.

D.C. power is supplied to the audible sound generator means 49 through a transistor 91 and a speaker on/off switch 89, which is an end position of the volume switch 52. The second, third and fourth outputs of both poles SW1A and SW1B of the function switch 79 are connected in parallel as inputs to OR gate 120, the output of which is connected to the base of transistor 91 and drives transistor 91 to a conductive state when "high". In this manner, the audible alarm generator means 49 will be activated and provide a variably selectible audible tone through speaker 90 whenever the function switch 76 is set to the second, third or fourth positions corresponding to lamp only, vibrator only or both lamp and vibrator and upon the generation of the constant alarm signal 75 from the alarm clock IC 71. As the constant alarm signal 75 is gated through transistor 110, as described above, the output of OR gate 120 will alternatingly switch at the cyclic rate of the cyclic signal 73 thereby providing cyclic power to the audible sound generator means 49 and a cyclic or alternating on and off tone from the speaker 90. Whenever the function switch 76 is in the first or off position, the audible sound generator means 49 will also be "off".

The alarm clock 10 uniquely includes a remote receiver means denoted generally by reference number 94 in FIGS. 4 and 5A which is adapted for receiving and detecting power line carrier signals transmitted over the power line conductors 23 by a remote transmitter 95 which generates a radio frequency power line carrier signal, such as 195 KHz carrier signal, with a variable frequency of plus or minus 100 hertz, in response to the detection of a sound producing event in proximity with the remote transmitter 95, such as the ringing of a doorbell 97. The remote transmitter 95 can also be responsive to other inputs or stimuli, such as a telephone ring signal, a contact voltage provided by a doorbell, a home alarm sensor output, etc. Further details concerning the operation of such remote receivers in detecting audible sounds generated by a sound producing event and generating and transmitting power line carrier signals over power line conductors can be had by referring to U.S. Pat. No. 4,365,238, the contents of which are incorporated herein by reference.

Upon receipt of a power line carrier signal, the receiver 94 demodulates the power line carrier signal from the A.C. power signal and generates a square wave output signal having a magnitude and period equal to the magnitude and period of the power line carrier signal. The square wave signal is connected to a remote enable (EN)—disable (DIS) switch 102 mounted on the back wall 24 of the housing 12. When the switch 102 is in the enable (EN) position, the square wave signal will be supplied by line 113 to both an input of OR gate 114 as shown in FIG. 5B and, also, to an input of OR gate 118. The signal on line 113 will thereby switch the output of the OR gates 114 and 118 to a "high" state which in turn, through the function switch 76 and the switch 78 will control the supply of electrical power to the first and second outlets 84 and 86 and, also, to the audible sound generator means 49 in the same manner as described above.

However, when the signal on line 113 is present, the supply of power to the first and second outlets 60 and 62 and the audible sound generator means 49 will be a cyclic signal corresponding to the magnitude and period of the received line carrier signal. In the case where the remote transmitters which detect the occurrence of various sound producing events, such as the ringing of the doorbell 97, the ringing of a telephone, the activation of a smoke detector, burglar alarm, or a sound detected by a baby or child monitor, etc., provide a coded carrier signal unique to each remote transmitter, the cyclic rate of the signal from the remote receiver means 94 through the logic circuit 74 to the outlets 60 and 62 and the audible sound generator 49 will cause the respective lamp 61, vibrator 64 and speaker 90 tone to also pulse in synchronization with the magnitude and period of the carrier line signals to enable the user to determine which remote event, such as a doorbell, telephone, baby monitor, smoke detector, etc., has occurred.

Figure 3:
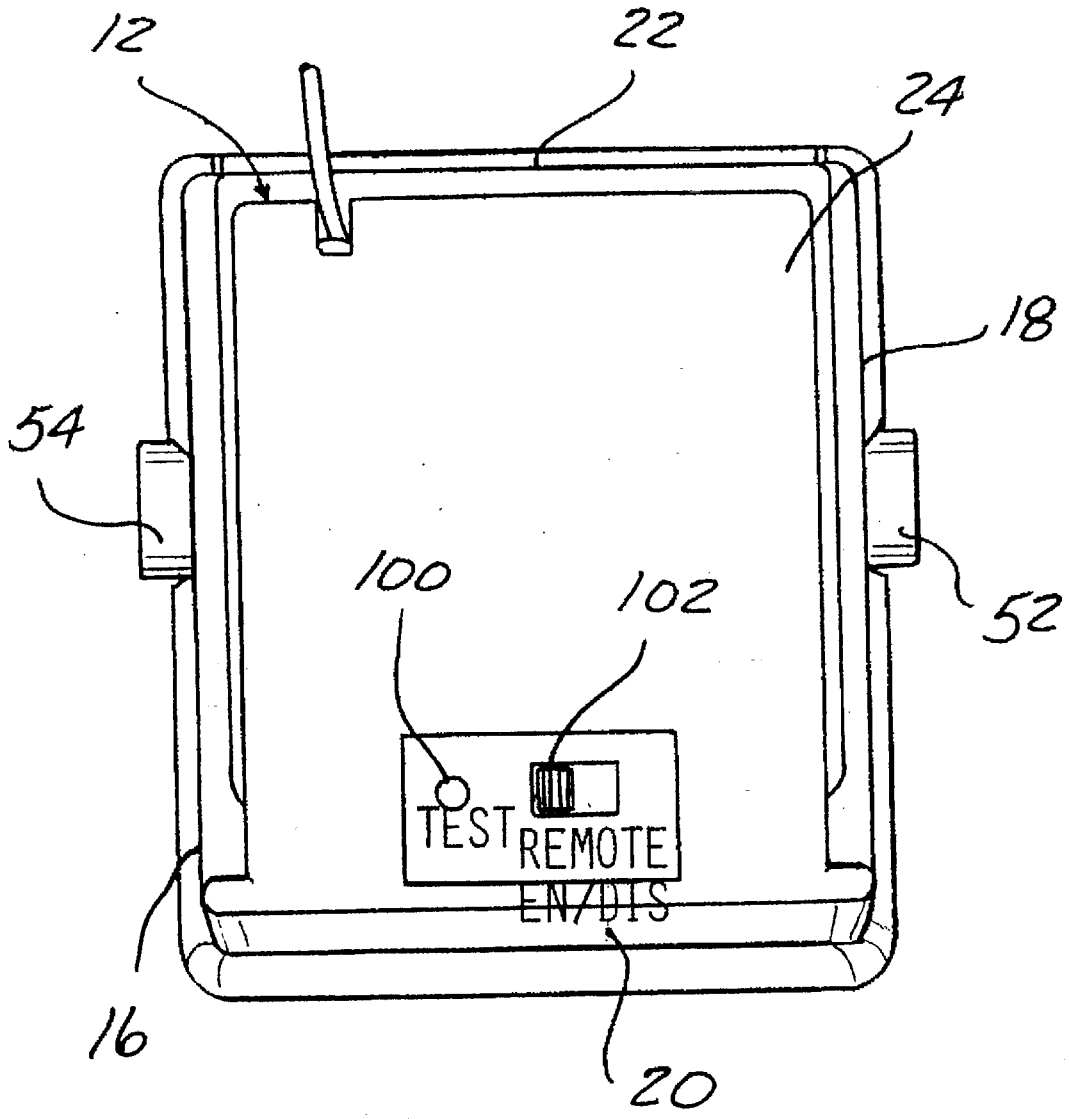
FIG. 3 is a bottom view of the alarm clock shown in FIG. 1.

Finally, a pushbutton 100, labelled "TEST", is mounted on the bottom wall 24 of the housing 12 as shown in FIG. 3. The pushbutton 100 is connected in parallel with the constant alarm signal 75 to the base of transistor 110 as shown in FIG. 5B.

When the test switch 100 is depressed, power is connected at the cyclic rate of the cyclic signal 73 through transistor 110 to both poles SW1A and SW1B of the function switch 96. This enables the user to determine the desired operation of the first and second outlets 60 and 62 as set by the position of the function switch 76 as well as the desired volume and tone settings on the audible sound generator means 49. The function switch 76 can be switched between its four positions, while the test switch 100 is held depressed, to verify that the outlets 60 and 62 and the audible sound generator means 49 receive power at the proper function switch 76 position.

In summary, there has been disclosed a unique alarm clock which provides selective electrical power to one or more outlets mounted on the alarm clock which receive plug-in electrically operated devices to provide visual and/or tactile signals to a deaf or hearing impaired person, or even a heavy sleeper, to indicate when an alarm signal is generated by the alarm clock. The alarm clock of the present invention uniquely contains receiver means for detecting power line carrier signals indicating the occurrence of a sound producing event or other signal or stimuli remote from the location of the alarm clock, such as the ringing of a doorbell or telephone, voices from a baby monitor, or alarm sounds from a smoke detector. This enables the user of the alarm clock to also be alerted upon the occurrence of any such remote sound producing event or other stimuli. This feature has heretofore been unavailable in alarm clocks, particularly alarm clocks devised for the deaf, hearing impaired or for heavy sleepers.

The alarm clock of the present invention also includes a test circuit which enables the user to test the operation of the alarm clock, particularly the activation of the various outlets and electrical devices connected thereto and the desired volume and tone settings on the audible sound generator without having to set a pseudo alarm time to activate the alarm clock in a normal manner.

What is claimed is:

1. An alarm clock connectible to electrical A.C. power lines, the alarm clock comprising:

a housing;

display means, mounted in the housing, for displaying time of day and preset alarm time information;

clock means, mounted in the housing, for generating and supplying time of day information to the display means, and for generating an alarm signal when the time of day corresponds to a preset alarm time;

means, mounted on the housing and input to the clock means, for setting time of day and alarm time information and for de-energizing the alarm signal;

a first electrical outlet, mounted in the housing, for supplying electrical power to a first external electrically operated device electrically connectible to the first outlet;

receiver means, mounted in the housing, for receiving and detecting power line carrier signals transmitted on the electrical A.C. power lines to the alarm clock from a to more device in response to the occurrence of an input stimuli detected by the remote device; and means, responsive to the clock means and the receiver means, for applying electrical power to the first outlet at one alternatingly on and off frequency in response to the generation of the alarm signal and at another distinct on and off sequence in response to the detection of the power line carrier signals by the receiver means.

2. The alarm clock of claim 1 further comprising:

audible sound generator means, mounted in the housing, for generating an audible sound in response to the alarm signal.

3. The alarm clock of claim 2 further comprising:

means for varying the frequency of the audible sound generated by the audible sound generating means.

4. The alarm clock of claim 2 further comprising:

means for varying the volume of the audible sound generated by the audible sound generating means.

5. The alarm clock of claim 1 further comprising:

a second electrical outlet mounted on the housing for supplying electrical power to a second external electrically operated device electrically connectible to the second outlet;

the means for applying electrical power also applying electrical power to the second outlet in response to any of the alarm signal and the power line carrier signals.

6. The alarm clock of claim 5 further comprising:

second switch means, coupled to the means for applying electrical power and to the second outlet, for switching the electrical power applied to the second outlet between a constant supply of power and a varying supply of electrical power at the one frequency of the alarm signal or the distinct on and off sequence of the power line carrier signals.

7. The alarm clock of claim 5 wherein:

the means for applying electrical power to the second outlet applies D.C. electrical power to the second outlet.

8. The alarm clock of claim 5 wherein:

the second electrical device electrically connectible to the second outlet is a vibrator.

9. The alarm clock of claim 5 further comprising:

test means, mounted on the housing and connected to the means for applying electrical power to the first outlet and to the second outlet, for activating the electrical power applying means to apply electric power in an alternating on and off sequence to the first outlet and to the second outlet independently from the alarm signal and the detection of power line carrier signals by the receiver means.

10. The alarm clock of claim 1 further comprising:

means, mounted on the housing, for deactivating the receiver means.

11. The alarm clock of claim 1 wherein the first external electrically operated device connectible to the first outlet is an illuminatable light.

12. The alarm clock of claim 1 further comprising:

test means, mounted on the housing and connected to the means, for applying electrical power to the first outlet, for activating the electrical power applying means to supply electric power to the first outlet independently from the alarm signal and the detection of power line carrier signals by the receiver means.

13. An alarm clock connectible to electrical A.C. power lines, the alarm clock comprising:

a housing;

display means, mounted in the housing, for displaying time of day and preset alarm time information;

clock means, mounted in the housing, for generating and supplying time of day information to the display means, and for generating an alarm signal when the time of day corresponds to a preset alarm time;

means, mounted on the housing and input to the clock means, for setting time of day and alarm time information and for de-energizing the alarm signal;

a first electrical outlet, mounted in the housing, for supplying electrical power to a first external electrically operated device connectible to the first outlet;

a second electrical outlet, mounted on the housing, for supplying electrical power to a second external electrically operated device electrically connectible to the second outlet;

receiver means, mounted in the housing, for receiving and detecting power line carrier signals transmitted on the electrical A.C. power lines connected to the alarm clock, from a remote device in response to the occurrence of an input stimuli detected by the remote device;

means, for applying electrical power to the first and the second outlets at one alternatingly on and off frequency in response to the generation of the alarm signal and at another distinct on and off sequence in response to the detection of the power line carrier signals by the receiver means;

first switch means, connected to the means for applying electrical power, for selectively switching electrical power to at least one of the first and second outlets; and audible sound generator means, mounted in the housing, for generating an audible sound in response to the alarm signal.

14. The alarm clock of claim 13 further comprising:

means for varying at least one of the frequency and volume of the audible sound generated by the audible sound generating means.

15. The alarm clock of claim 13 further comprising:

test means, mounted on the housing and connected to the audible sound generating means and to the means for applying electrical power to the first outlet and to the second outlet, for activating the electrical power applying means to apply electric power to the first and second outlets independently from the alarm signal and the detection of power line carrier signals by the receiver means and to activate the audible generating means to enable adjustments thereto.

16. An alarm clock connectible connectible to electrical A.C. power lines, the alarm clock comprising:

a housing;

display means, mounted in the housing, for displaying time of day and preset alarm time information;

clock means, mounted in the housing, for generating and supplying time of day information to the display means, and for generating an alarm signal when the time of day corresponds to a preset alarm time;

means, mounted on the housing and input to the clock means, for setting time of day and alarm time information and for de-energizing the alarm signal;

a first electrical output, disposed in the housing, for supplying electrical power to a first electrically operated device electrically connectible to the first output;

receiver means, mounted in the housing, for receiving and detecting power line carrier signals transmitted on the electrical A.C. power lines to the alarm clock from a remote device in response to the occurrence of an output stimuli detected by the remote device; and means, responsive to the clock means and the receiver means, for applying electrical power to the first output at one alternatingly on and off frequency in response to the generation of the alarm signal and at another distinct on and off sequence in response to the detection of the power line carrier signals by the receiver means.

17. The alarm clock of claim 16 further comprising:

audible sound generator means, mounted in the housing, for generating an audible tone in response to the alarm signal; and means, mounted on the housing, for manually varying a frequency of the audible sound generated by the audible sound generating means.

18. The alarm clock of claim 17 further comprising:

test means, mounted on the housing and connected to the audible sound generating means, for activating the electrical power applying means to supply electric power to the audible sound generating means independently from the alarm signal to permit adjustment of the frequency of the audible sound generating means.

19. The alarm clock of claim 18 wherein:

the audible sound generating means includes independently manual adjustable means for varying the frequency of the sound generated by the audible sound generating means, and independently manual adjustable means for varying the volume of the sound generated by the audible sound generating means.

* * * * *

UNITED STATES PATENT AND TRADEMARK OFFICE

CERTIFICATE OF CORRECTION

PATENT NO. : 5,666,331

DATED : September 9, 1997

INVENTOR(S) : Adam J. Kollin

It is certified that error appears in the above-identified patent and that said Letters Patent is hereby corrected as shown below:

Claim 1, line 37, after "a", delete "to" and add remote.

Claim 1, line 38, remove "more".

Signed and Sealed this

Twentieth Day of January, 1998

Bruce Lehman

*Attest:*

BRUCE LEHMAN

*Attesting Officer*

*Commissioner of Patents and Trademarks*